US007604501B2

(12) United States Patent
Rösch et al.

(10) Patent No.: US 7,604,501 B2
(45) Date of Patent: Oct. 20, 2009

(54) BUS CONNECTOR WITH AT LEAST TWO CABLE CONNECTIONS FOR BUS LINES

(75) Inventors: Ernst Rösch, Amberg (DE); Ulf Stein, Grasellenbach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/077,650

(22) Filed: Mar. 20, 2008

(65) Prior Publication Data

US 2008/0242119 A1 Oct. 2, 2008

(30) Foreign Application Priority Data

Mar. 30, 2007 (EP) ..... 07006735

(51) Int. Cl.
*H01R 13/648* (2006.01)

(52) U.S. Cl. ..... 439/607.01

(58) Field of Classification Search ..... 439/49, 439/610, 456, 465, 607, 76.1, 497, 607.01, 439/607.56, 98, 607.04, 607.15, 607.27, 439/607.28, 607.41, 607.42
See application file for complete search history.

(56) References Cited

U.S. PATENT DOCUMENTS 5,244,415 A 9/1993 Marsilio et al.
5,409,400 A 4/1995 Davis
5,899,772 A * 5/1999 Beaver et al. ..... 439/610
6,139,365 A 10/2000 Lok
6,210,229 B1 4/2001 Lai
7,267,575 B1 * 9/2007 Hwang ..... 439/497

FOREIGN PATENT DOCUMENTS

DE 196 02 156 C1 6/1997
EP 0 606 739 A2 7/1994
EP 1 309 040 A1 5/2003

* cited by examiner

*Primary Examiner*—Edwin A. Leon

(57) ABSTRACT

There is described a bus connector with at least two cable connections for bus lines, with the cable connections being provided in each case for electrical connection to a bus signal line and a bus screen line of a cable, with a screen connector of the cable connection being provided for electrical contacting of the bus screen connection of the cable to the elements screening the bus connector. The screen connector is embodied as a flat screening of the cable connections and contact elements are arranged in the area of the contacting of the bus screen lines which are intended for automatic contacting of the bus screen lines with the elements of the bus connector screening it when clamped on during installation of the housing.

15 Claims, 2 Drawing Sheets

BUS CONNECTOR WITH AT LEAST TWO CABLE CONNECTIONS FOR BUS LINES

CROSS REFERENCE TO RELATED APPLICATIONS

This application claims priority of European Patent Office application No. 07006735.0 EP filed Mar. 30, 2007, which is incorporated by reference herein in its entirety.

FIELD OF INVENTION

The invention relates to a bus connector with at least two cable connections for bus lines, with the cable connections being provided in each case for electrical connection to at least one bus signal line and a bus screening line of a cable, with a screen connector of the cable connection being provided for electrical contacting of the bus screen line of the cable with elements screening the bus connector.

BACKGROUND OF INVENTION

This type of bus connector is used in conjunction with field busses, especially with PROFIBUS. The bus connector makes it possible to couple a bus user to the bus lines, with the bus connector being provided as a rule for connection of two cables, if necessary coaxial cables, each of which features a bus screen line and at least one screened control line respectively. The connection between bus user and the bus connector is established by means of a socket, for example a D-Sub connection. If necessary the bus connector has additional connection options for other devices, such as programming devices for example which are used for programming or planning the bus users into a project.

Conventional bus connectors have screening elements in order to exclude damage to circuits within the bus connector or in the bus user. Conventional bus connectors are for example implemented with metalized housings, with asymmetrical metal screens or with open, skeletal metal screening frameworks. If the screening of interference currents is guaranteed by metalized housings, the necessity arises of implementing the respective housing with very great precision in order to securely suppress interference fields which especially arise with cracks of gaps that are not covered.

Ongoing usage causes the housings of the bus connector to suffer, so that secure closure can also not be guaranteed over their entire service life.

With open or skeletal metal screening frameworks interference fields occur in any event around the screening components which sharply reduce the burst stability or electromagnetic (EM) compatibility. With said metal screen solutions, but especially with the metalized housing, a lasting secure contacting (for example during vibration or environmental stress) within the screening system can only be guaranteed with difficulty or not at all.

SUMMARY OF INVENTION

An object of the invention is to specify a bus connector which guarantees a lasting secure contacting of the elements to be screened and which can be produced at low cost.

This object is achieved for a bus connector of the type mentioned at the start by the screen connector being embodied as flat screening of the cable connections and in the area of the contacting of the bus screen lines featuring contact elements which are designed for automatic contacting of the bus screening lines with the screening elements of the bus connector through clamping during the installation of the housing of the bus connector.

Inventively the bus connector has at least two cable connections for bus lines. The cable connections are intended in each case for electrical connection to at least one bus signal line and a bus screen line of a cable, especially of a coaxial cable. (Where necessary the cable connection is provided for a number of signal lines of a bus.) A screen connector of the cable connection guarantees the electrical contacting of the bus screening line of the cable to the screening elements of the bus connector. The screening of the cable is thus combined with the screening of the bus connector into an overall screening system, referred to simply as a screening system for short.

The screen connector inventively combines at least two functions, namely the connection of the bus screen line to the screening elements of the bus connector and at the same time assumes a screening function, in which the cable connections and where necessary further electrical modules of the of the bus connector are to be screened. To this end the bus connector is flat in shape and where necessary is adapted to the form of the cables which contain the bus lines. The screened connector has contact elements in the area of contacting the bus screen lines which are intended for automatic contacting of the bus lines. During installation the isolated bus screen line of the cable is placed on the contact element or elements and by means of clamping during the installation of the housing or of a housing part is pressed onto the contact element. The cable is thus fixed in its position and the contacting, and thereby also the establishment of the overall screening system, is safeguarded with the screen connector.

Advantageously the said clamping of the bus screen lines is undertaken for a number of cables simultaneously, which guarantees very simple installation.

Advantageously the screening effect of the screening connector is supported by a partly undulating and/or bowl-shape form of said connector. It is advantageous for the screening effect of the screen connector to be guaranteed as a result of the metallic material and simultaneously as a result of the shape of the screening connector for a housing which does not necessarily have to have a screening effect to be able still to be used for clamping. Although a metallic housing part further contributes to screening, it can however also be replaced by a non-screening housing part, such as a plastic housing part for example, since the screen connector already provides sufficient screening.

Advantageously the screen connector is provided for soldering to the elements screening the bus connector, especially a screening plate screening a circuit board, or also a screening layer. Soldering of the screen connector promotes structural stability of the entire screening system, with no decontacting occurring as a result of lasting or heavy strain on the bus connector, as it does for example with push-in contacting. The screening characteristics of the overall screening system consequently do not suffer or hardly suffer at all during use. As well as the long-term stability, touch contacting or its possible sources of error are also excluded, which means that a higher process security, a lower harmful gas corrosion and a sufficient vibration resistance can be guaranteed.

Advantageously a metalization or a full metal housing is not necessary since, through the measures specified, the desired electromagnetic behavior in accordance with standard (EN61000-4-4) is achieved.

Advantageously when a plastic housing part or plastic housing is used, there is a simplification of the requirements for constructing the housing by comparison with a metalized or a full metal housing, in which prescribed stress distances have to be adhered to and which leads as a rule to voluminous bus connectors. Because a plastic housing part or housing is used, no account need be taken of stress distances, which is to the benefit of the housing dimensions.

Advantageously the screen connector is integrated into an element screening the bus or embodied as one piece with the latter. This is likewise beneficial to the stability of the overall screening concept and further simplifies the connector structure which reduces the number of parts involved. This means in particular that a combination with screening structural or housing parts is conceivable, which are likewise of a flat design.

With an advantageous embodiment the screen connector is embodied as a metal screen of which the shape is adapted to the shape of the cables. Advantageously the metal screen is also to be embodied without openings or holes which might cause interference fields. Furthermore it should be ensured that the bus signal lines are located within the metal screen when the bus connector is mounted correctly.

Advantageously the screening connector is embodied partly undulating and/or bowl-shaped, with the cables or the bus signal lines being located within the "bowl".

In an advantageous embodiment the screen connector is embodied as a metallic punched part, with the manufacturing costs able to be reduced not only by the smaller number of components, but also by the fabrication costs.

Advantageously in addition to at least one male plug connector, such as a D-Sub male connector for example, for connection to a bus user a socket connector (female) is also provided for example for a programming device which can be included for programming the bus user.

With an advantageous embodiment the screen connector likewise takes over the functions of screening other components of the bus connector, such as the D-Sub socket, the circuit board or other screening elements for example.

Advantageously the bus connector is embodied as a PROFIBUS bus connector.

Further advantageous embodiments and preferred developments of the invention are to be taken from the descriptions of the figures and/or the subclaims.

BRIEF DESCRIPTION OF THE DRAWINGS

The invention is described and explained in more detail below on the basis of the exemplary embodiments shown in the figures.

The figures show.

DETAILED DESCRIPTION OF INVENTION

Figure 1:
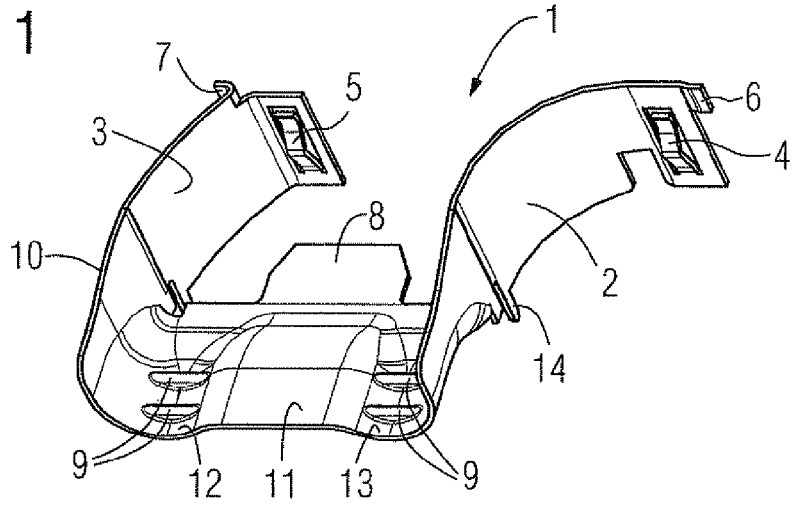
FIG. 1 a screening connector embodied as a metal screen.
Figure 2:
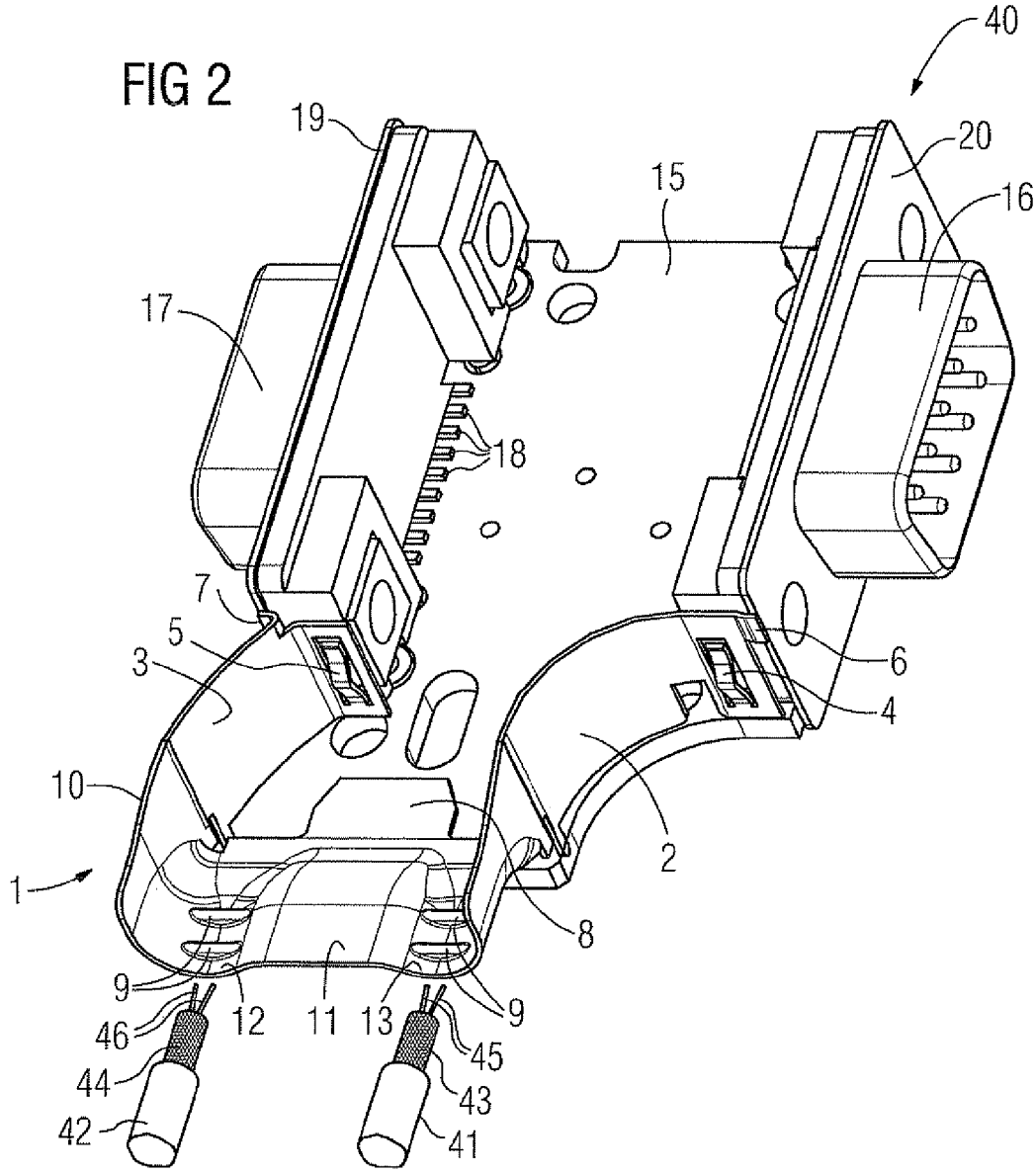
FIG. 2 a bus connector with the screening connector from FIG. 1

FIG. 1 and FIG. 2 show a screening connector 1 embodied as a metal screen, which is intended to be attached to a bus connector 40.

Clips 4, 5, which can be pushed behind a retaining facility on the bus connector 40, can be used as mechanical connections to the bus connector 40 so that, because of their elasticity, they then keep the screening connector 1 attached to the bus connector 40. The solder surface 8 is designed to be soldered onto a screening plate 15 which in its turn is designed for screening of the circuit board which is contacted with bus control lines 45, 46. The circuit board and also the cable connections are located in the fully-assembled state on the screening plate 15 or possibly partly within the screened connector 1, but in any event are not shown in FIGS. 1 and 2.

The screened connector 1 also has face surfaces 2, 3 which are necessary to achieve EM compatibility and simultaneously take account through their shape of a certain connection geometry of the cables 41, 42.

As well as the solder surface 8 solder tags 6, 7 are also provided which improve the electrical conductivity within the overall screen. The pins 14 can merely be used for positioning of the screen connector 1 on the screening plate 15 or likewise as a solder point.

The contact elements 9 are arranged in the contacting area 12 and 13 of the bus screen lines 43, 44. The arrangement of the contacting elements 9 corresponds to the deepest point of there partly bowl-shaped recesses of the screen connector 1. The bowl shape is especially supported by the raised section 11, which means that the cables 41, 42 are to a certain extent "automatically" able to be pushed into the respective "bowl" when the housing part is pushed onto the cable 41, 42 (housing part is not shown). The housing part could in this case typically cover the entire screen connector 1 or also further parts of the bus connector 40. In this case the housing part is for example a component of the overall housing which is made of plastic and is arranged around the bus connector or around its screening.

Advantageously a D-Sub connector 16 is attached to the bus connector 40 by which the latter can be connected in a simple manner to a bus user, such as an actuator, a sensor, a microcontroller or similar for example. A further socket 17 allows connection to the circuit board by means of contacts 18, with a connection of a programming or project planning device being possible in this way which can program the bus users locally or plan them into a project.

The connectors 16, 17 are arranged on the flat screens 19, 20 of the bus connector which represent elements of its screening. These are likewise able to be electrically contacted via the clips 4, 5 or the solder points 6, 7 to the screen connector 1.

Figure 3:
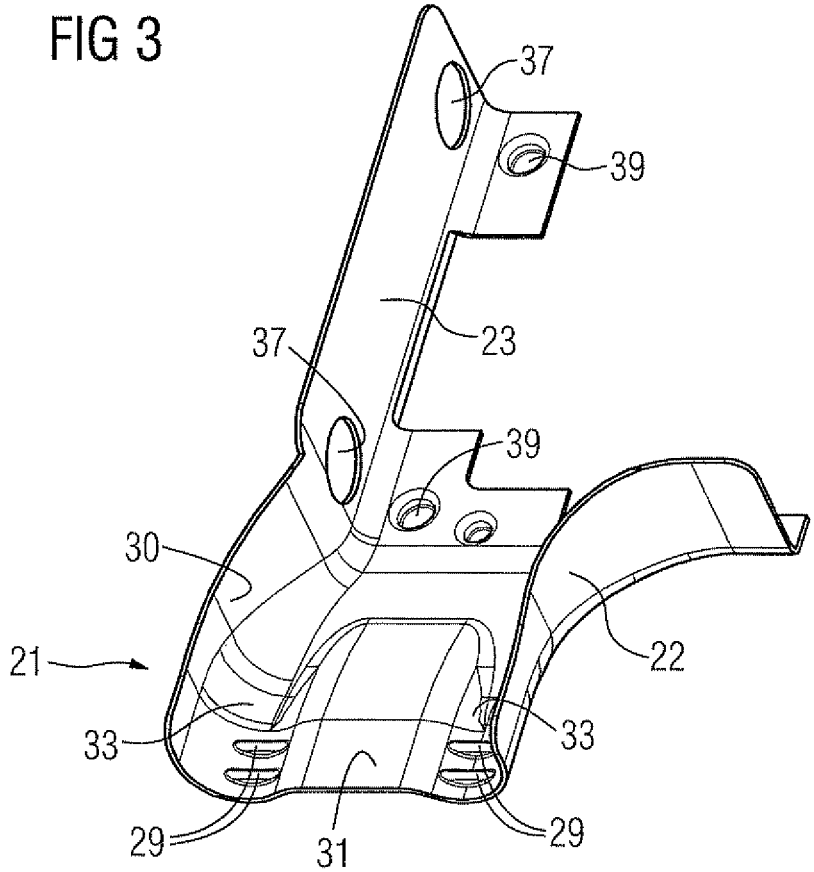
FIG. 3 an integrated screening connector.
Figure 4:
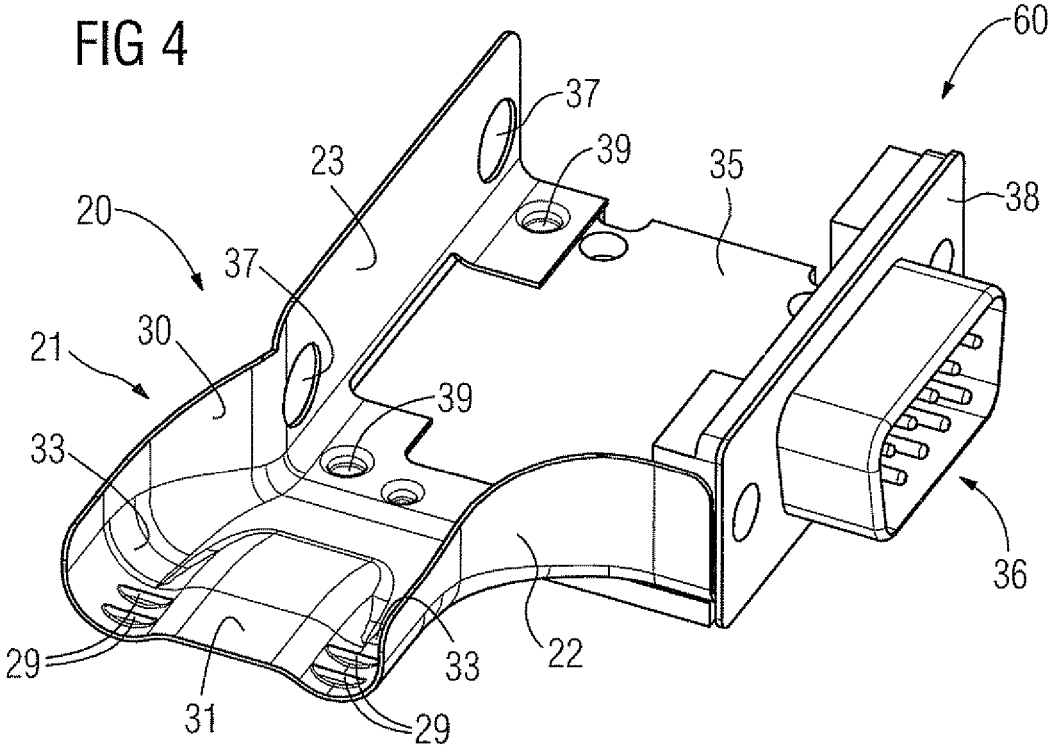
FIG. 4 a bus connector with the integratable screening connector from FIG. 3.

FIG. 3 and FIG. 4 show an integrated screen connector 21 which is integrated into a bus connector 60.

The embodiments for FIGS. 3 and 4 essentially correspond to those from FIGS. 1 and 2, with the bus connector now being embodied as bus connector 21 and essentially being in one piece with the screening element 23. This design leads to a lower number of parts and a certain simplicity of the bus connector 60 compared to the bus connector 40 of FIGS. 1 and 2. The bus connector 60 has fewer touch surfaces within the overall screen and is therefore better protected against burst currents.

The connection of project planning or programming devices is not possible with bus connector 60.

There is provision for the screen connector 21 embodied as a metal screen to also take over further screening functions, by further components of the bus connector 60 being integrated into it. It is thus conceivable for example for the screening element 38 and/or the screening plate 35 to also be integrated with this or to be embodied in one piece with this.

The recesses 39 facilitate the electrical contacting to the screening plate 35 and are arranged in the vicinity of the openings 37 which are used for the passage of screw-like attachment means.

The same then applies to the contacting elements 29, the areas 33 and the raised section 31 as to the contacting elements 9, the areas 12, 13 and the raised section 11 of FIG. 1.

Advantageously mechanical contact mechanisms (such as the clips 4, 5, from FIG. 1) of the screen connector for contacting the screening plate 35 are not needed for this embodiment.

In summary the invention relates to a bus connector with at least two cable connections for bus lines, where the cable connections are provided in each case for electrical connection to at least one bus signal line and a bus screen line of a cable, with a screen connector of the cable connection being provided for electrical contacting of the bus screen connection of the cable with the elements screening the bus connector. The aim is to achieve cost savings in manufacturing and component costs compared to metalization or metal housings of these types of bus connector, with an identical or a better EMC behavior. To this end the screen connector is embodied as a flat screening of the cable connections and contact elements are arranged in the area of the contacting of the bus screen lines which are intended for automatic contacting of the bus screen lines with the screening elements of the bus connector through clamping during installation.

The invention claimed is:

1. A bus connector with at least two cable connections for bus lines, wherein the cable connections provide an electromechanical connection with at least a bus signal line and a bus screen line of a cable, comprising:

a screen connector to provide an electromechanical contact of the bus screen line of the cable with elements screening the bus connector, the screen connector being configured to provide electromagnetic screening to at least the bus signal line, wherein the screen connector has a flat screening of the cable connections, and wherein the screen connector has at least one contact element to contact the bus screen line automatically by clamping, such that the bus screen line is electromechanically connected to the elements screening the bus connector, when a housing of the bus connector is installed, wherein the screen connector includes a bowl-shaped recess for receiving the bus signal line, wherein said at least one contact element is disposed in the bowl-shaped recess, wherein the bowl-shaped recess is adjacent to a raised section of the screen connector, wherein the bowl-shaped recess contributes to the electromagnetic screening provided to the bus signal line received therein.

2. The bus connector as claimed in claim 1, wherein the screen connector is soldered to an element screening the bus connector.

3. The bus connector as claimed in claim 2, wherein a screening plate screens a circuit board.

4. The bus connector as claimed in claim 1, wherein the screen connector is an element screening the bus connector.

5. The bus connector as claimed in claim 4, wherein a screening plate screens a circuit board.

6. The bus connector as claimed in claim 1, wherein the screen connector is a metal screen, and wherein the screen connector has a form adapted to a form of the cable.

7. The bus connector as claimed in claim 1, wherein the screen connector has a undulating shape.

8. The bus connector as claimed in claim 1, wherein the screen connector has a metallic stamped part.

9. The bus connector as claimed in claim 1, wherein the screen connector has a metalized stamped part.

10. The bus connector as claimed in claim 5, wherein the screen connector has a metallic stamped part.

11. The bus connector as claimed in claim 5, wherein the screen connector has a metalized stamped part.

12. The bus connector as claimed in claim 9, wherein the screen connector has a metallic stamped part.

13. The bus connector as claimed in claim 9, wherein the screen connector has a metalized stamped part.

14. The bus connector as claimed in claim 1, further comprising at least one connection socket for a connection to a bus user.

15. The bus connector as claimed in claim 1, wherein the bus connector is a PROFIBUS connector.

* * * * *